US009303963B1

(12) United States Patent
Ford

(10) Patent No.: US 9,303,963 B1
(45) Date of Patent: Apr. 5, 2016

(54) MECHANICAL BROADHEAD

(71) Applicant: 2327086 Ontario Ltd., Nottawa (CA)

(72) Inventor: Randolph K. Ford, Nottawa (CA)

(73) Assignee: Nex Gen Crossbows, Inc., Mount Forest, Ontario (CA)

( * ) Notice: Subject to any disclaimer, the term of this patent is extended or adjusted under 35 U.S.C. 154(b) by 0 days.

(21) Appl. No.: 14/494,794

(22) Filed: Sep. 24, 2014

(51) Int. Cl.
*F42B 6/08* (2006.01)
*F42B 12/34* (2006.01)

(52) U.S. Cl.
CPC .. *F42B 12/34* (2013.01); *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 5,458,341 | A * | 10/1995 | Forrest et al. | ..... | 473/583 |
| 5,879,252 | A * | 3/1999 | Johnson | ..... | 473/583 |
| 6,015,357 | A * | 1/2000 | Rizza | ..... | 473/583 |
| 6,595,881 | B1 * | 7/2003 | Grace et al. | ..... | 473/583 |
| 8,062,155 | B2 * | 11/2011 | Butcher | ..... | 473/582 |
| 8,801,552 | B2 * | 8/2014 | Miles | ..... | 473/583 |
| 2006/0084535 | A1 * | 4/2006 | Kuhn | ..... | 473/583 |

* cited by examiner

*Primary Examiner* — John Ricci
(74) *Attorney, Agent, or Firm* — Olson & Cepuritis, Ltd.

(57) ABSTRACT

A mechanical broadhead has an elongated body and a plurality of cutting blades pivotably mounted to the elongated body. The cutting blades, when in a folded position, nest in longitudinally extending slots in the elongated body, but assume an extended position when the broadhead enters a target.

19 Claims, 5 Drawing Sheets

MECHANICAL BROADHEAD

FIELD OF INVENTION

This invention relates to an arrowhead, and more particularly to a mechanical broadhead suitable for hunting game.

BACKGROUND OF INVENTION

One type of arrowhead used for hunting is a broadhead. This type of arrowhead has good penetrating power and creates a relatively large entry wound. To that end, a mechanical broadhead utilizes pivotable blades that extend laterally as the broadhead penetrates the intended target. For the hunter's arrow to be effective, however, the arrow in flight must travel a substantially straight path to the target.

Bows and crossbows that are commercially available impart different speeds to arrows. The inertia of the arrow leaving a very fast bow can cause mechanical broadheads to deploy cutting blades prematurely, thereby undesirably increasing blade profile and causing the arrow to veer off the intended flight path, or creating sufficient drag so as to reduce efficacy at impact. Also, at times the cutting blades on a mechanical broadhead may not deploy fully at impact, thereby decreasing the kill efficacy of the arrow.

The present invention obviates, or at least minimizes the aforementioned drawbacks by enhancing the broadhead's flight characteristics as well as kill efficacy.

SUMMARY OF INVENTION

A mechanical broadhead for use with an arrow, and providing a positive, controlled deployment of cutting blades, includes an elongated body having a leading end and a trailing end, provided with a faceted pointed tip, and defining a plurality of longitudinally extending slots substantially parallel to the longitudinal axis of the elongated body but offset from the longitudinal axis. The elongated body at its trailing or proximal end terminates in a threaded rod for connection to the shaft of an arrow. An internally threaded ferrule can be provided on the threaded rod for selecting a desired cutting profile by adjusting the pivot arc of the cutting blades upon deployment.

A plurality of independently deployable cutting blades is pivotably mounted to the elongated body portion. Preferably, three independently deployable cutting blades are provided. Each blade has a minor cutting edge, a major cutting edge, and a grab hook spaced from the distal end of the minor cutting edge. The major cutting edge is received within the longitudinally extending slot in the body portion when the blade is in a folded position while the minor cutting edge remains exposed. In this manner the blade profile is minimized during flight.

The major cutting edge-to-minor cutting length ratio is in the range of about 2 to about 4. Each cutting blade is configured so that each major cutting edge and its associated minor cutting edge define therebetween an acute angle. Preferably the acute angle is in the range of about 30 degrees to 60 degrees, more preferably about 45 degrees.

An elastomeric retainer holds the cutting blades in a retracted or folded position while the arrow is in flight but releases the cutting blades to an extended position as the arrow hits the target and penetrates. The elastomeric retainer allows adjustment of preload deployment tension to match the speed of the arrow.

The individual blades have a pointed, sharp-edged configuration comprising a deltoid head portion and a unitary stem portion extending therefrom. The stem portion defines a pivot pin aperture at its extremity. The cutting blades are individually mounted and independently deployable, thereby facilitating replacement when damaged.

DESCRIPTION OF PREFERRED EMBODIMENTS

Figure 1:
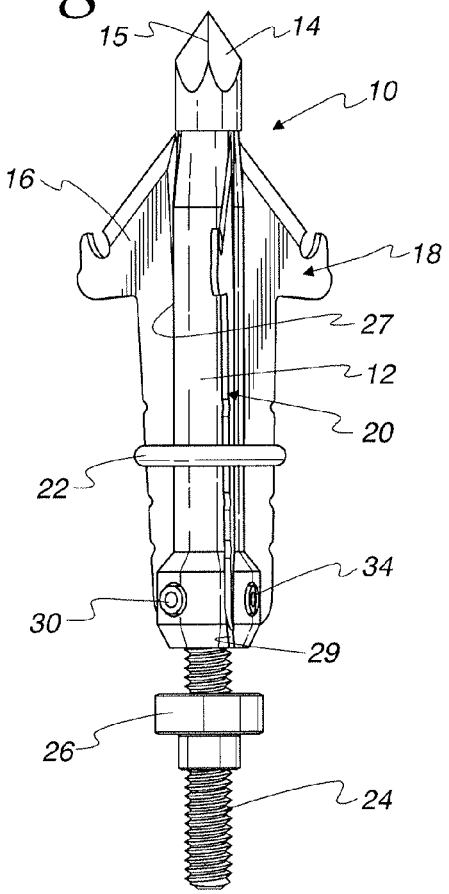
FIG. 1 is a side view of a mechanical broadhead embodying the present invention and showing cutting blades in a folded position.
Figure 2:
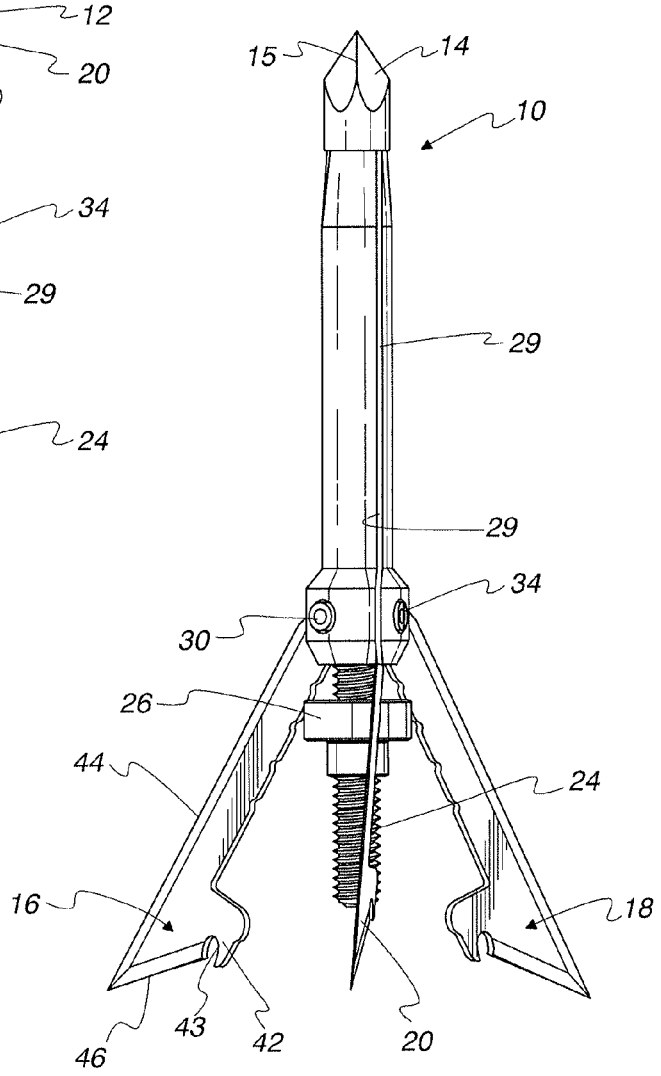
FIG. 2 is a side view of the mechanical broadhead of FIG. 1 but showing cutting blades in an extended position.

Referring to FIGS. 1 and 2, mechanical broadhead 10 comprises elongated body 12 provided with removable, faceted penetrating tip 14 with tip cutting edges such as edge 15. Penetrating tip 14 is threadedly mounted to elongated body 12 at the leading end thereof. Cutting blades 16, 18 and 20 are pivotably mounted to elongated body 12 by respective pivot pins 30, 32 and 34. In FIG. 1 cutting blades 16, 18 and 20 are shown in a folded position, received in longitudinally extending slots in elongated body 12 such as slot 29 for cutting blade 20 and held in place by an elastomeric retainer such as o-ring 22.

FIG. 2 shows cutting blades 16, 18 and 20 in an extended position. As a broadhead-carrying arrow is released from a bow or crossbow, and during the flight of the arrow, cutting blades 16, 18 and 20 remain in the folded position until broadhead 10 strikes a target. As penetrating tip 14 enters the target, cutting blades 16, 18 and 20 are pivoted from the folded position of FIG. 1 to an extended position shown in FIG. 2 as will be described in greater detail below. The cutting profile of the broadhead can be adjusted by adjusting blade pivot arc. The range of pivot arc traveled by the cutting blades is adjustable, and is determined by the position of ferrule 26 on threaded rod 24 that extends rearwardly from elongated body 12. The particular pivot arc utilized is dependent on the desired cutting diameter. Preferably the pivot arc is in the range of about 110 degrees to about 160 degrees, preferably about 135 degrees.

Figure 3:
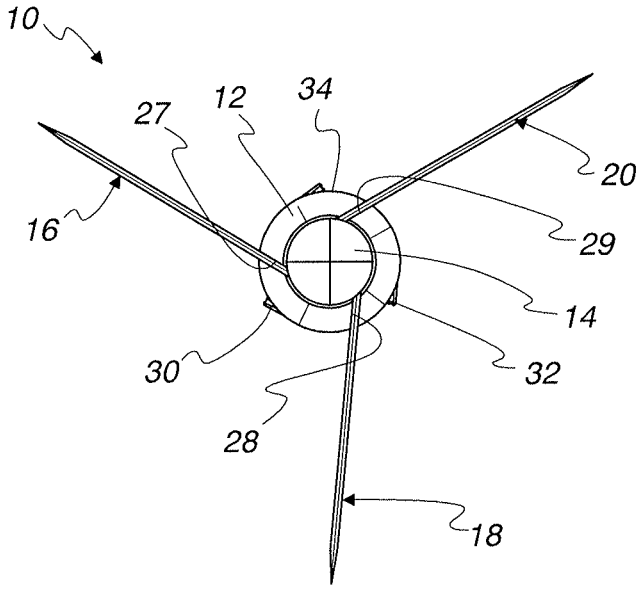
FIG. 3 is an end view of the mechanical broadhead of FIG. 1.
Figure 4:
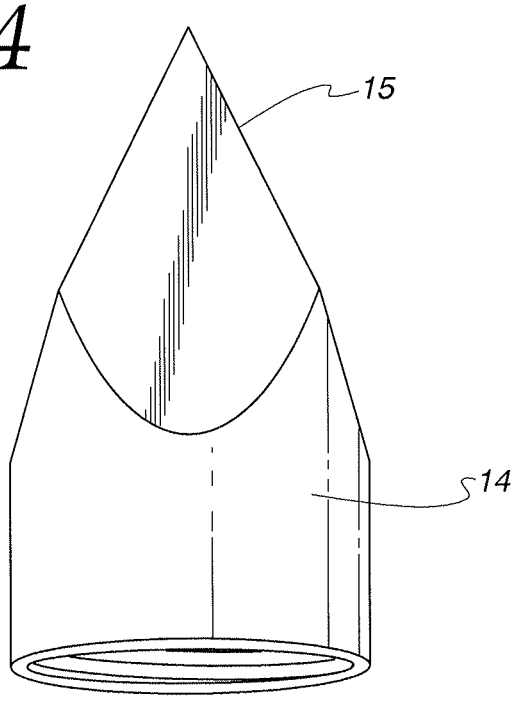
FIG. 4 is a side view of a removable, faceted tip of a mechanical broadhead embodying the present invention and provided with a plurality of cutting edges.

Deployment of cutting blades 16, 18 and 20 is further illustrated in FIG. 3. The cutting blades 16, 18 and 20 are deployed outwardly from respective longitudinally extending slots 27, 28 and 29 which are substantially parallel to the longitudinal axis of elongated body 12 but are offset from that axis. An enlarged perspective view of faceted tip 14 having tip cutting edges 15 is shown in FIG. 4.

Figure 5:
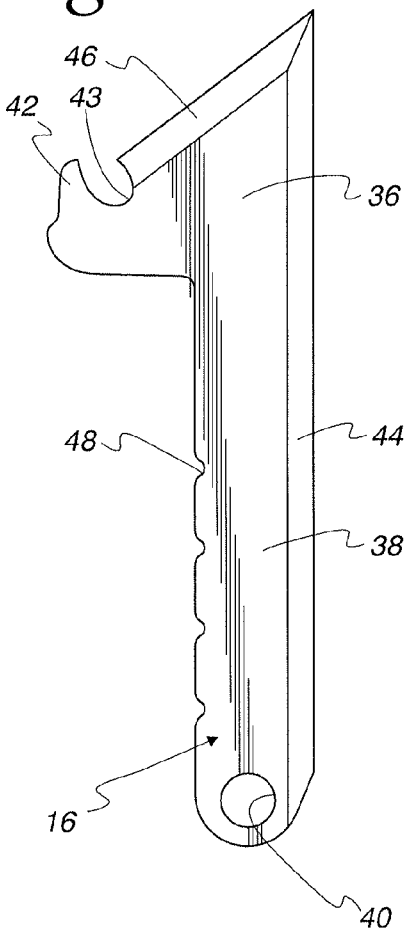
FIG. 5 is a side view of a cutting blade in the mechanical broadhead shown in FIG. 1.

FIG. 5 illustrates a typical cutting blade 16 for mechanical broadhead 10. A plurality of cutting blades, such as that shown in FIG. 5, carried by broadhead 10 are situated symmetrically relative to and about the longitudinal axis of elongated body 12. At least two, and preferably three, independently deployable cutting blades are pivotably mounted to elongated body 12.

Cutting blade 16 has a pointed, sharp-edged configuration, a leading, deltoid head portion 36 and a unitary stem portion 38 that extends rearwardly from the head portion. Stem portion 38 defines pivot pin aperture 40 at its extremity, i.e., at the distal end portion of stem portion 38. Major cutting edge 44 extends substantially along the entire length of cutting blade 16. An additional, minor cutting edge 46 is provided in head portion 36. Major cutting edge 44 and minor cutting edge 46 intersect and together define an included acute angle alpha ($\alpha$), preferably in the range of about 30 degrees to about 60 degrees, more preferably about 45 degrees.

Grab hook 42 unitary with head portion 36 is provided outboard of and spaced from minor cutting edge 46 by recess or cut-out 43 in head portion 36 of cutting blade 16. Preferably, grab hook 42 projects or extends forwardly from minor cutting edge 46. Grab hook 42 enhances positive deployment of cutting blade 16 from the folded position to the extended position by grabbing the skin or hide of the target animal upon entry of the cutting blade.

Stem portion 38 also defines a series of notches such a notch 48 on the side of stem portion 38 opposite major cutting edge 44. An elastomeric retainer such as o-ring 22 (FIG. 1) selectively engages such notches to provide a desired consistent retaining force or tension on the cutting blades while the broadhead-carrying arrow is in flight toward a target and also precludes premature deployment of the cutting blades.

Figure 6:
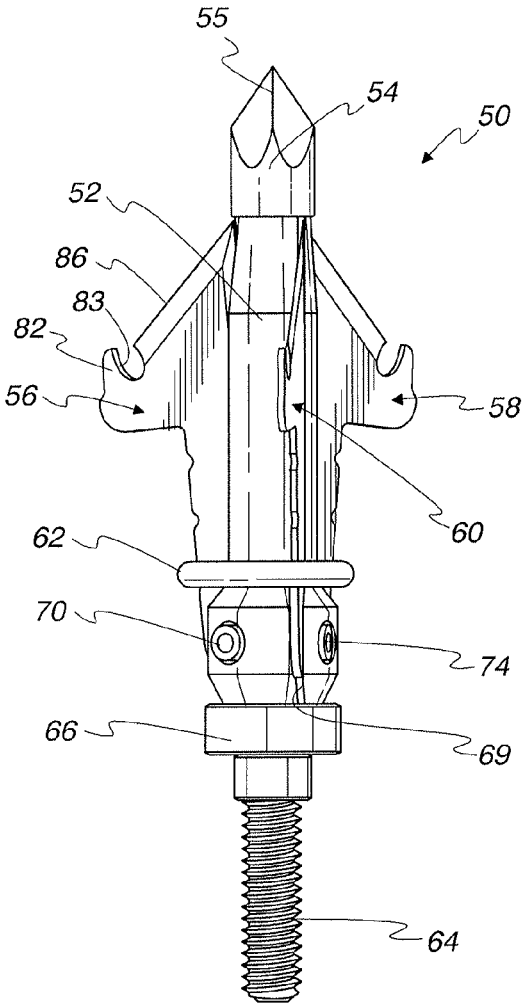
FIG. 6 is a side view of another mechanical broadhead embodying the present invention and showing cutting blades in a folded position.
Figure 7:
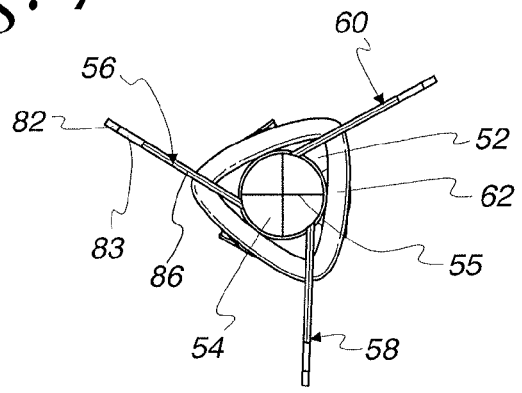
FIG. 7 is a front view of the mechanical broadhead of FIG. 6.
Figure 8:
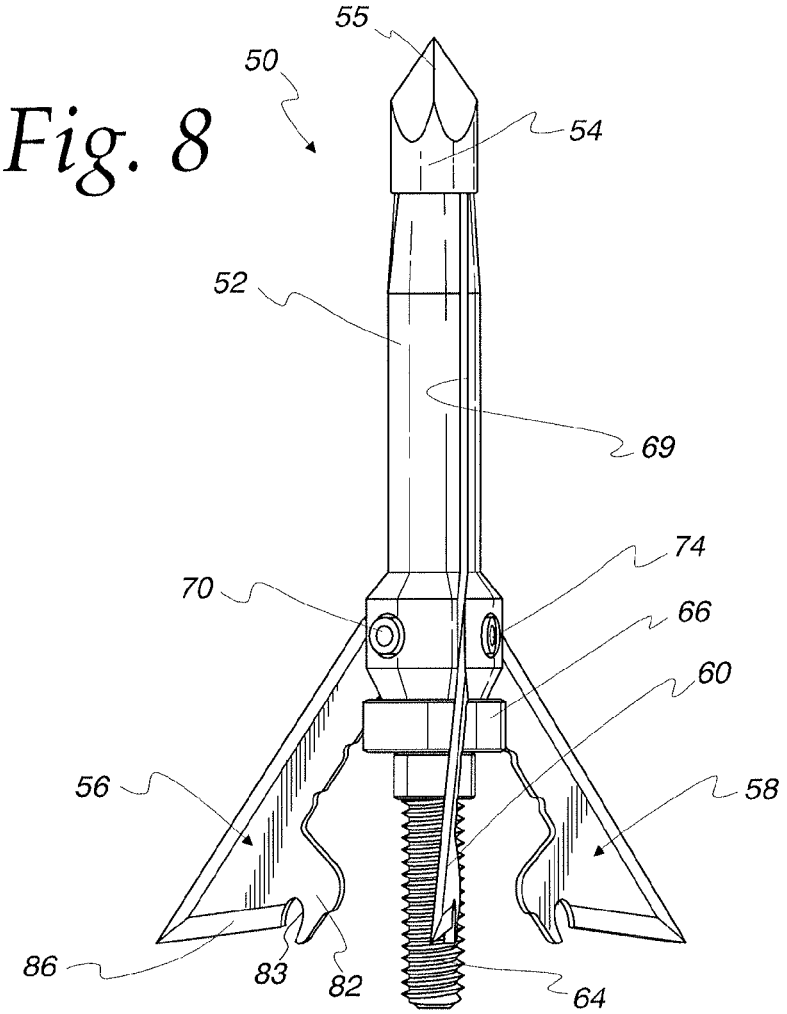
FIG. 8 is a side view of the mechanical broadhead shown in FIG. 6 but showing cutting blades in an extended position.

Another broadhead embodying the present invention is shown in FIGS. 6, 7 and 8. In this particular embodiment the overall arrangement of parts is the same as that for mechanical broadhead 10, but the body portion as well as the pivotable cutting blades mounted thereto are relatively shorter than the corresponding parts for broadhead 10. In particular, as shown in FIGS. 5, 6 and 7, cutting blades 56, 58 and 60 of broadhead 50 are pivotably mounted to elongated body 52 by pins such as pivot pins 70 and 74 and are held in a folded position by o-ring 62 or the like. Longitudinally extending slots, such as slot 69 for cutting blade 60, are provided for each of the cutting blades and are offset from the longitudinal axis of body 52 in same manner as slots 27, 28 and 29 discussed hereinabove. Threaded rod 64 extends from body portion 52 from the end thereof opposite to penetrating tip 54 and is adapted to be threadedly received into the shaft of an arrow. Threaded rod 64 also carries an internally threaded ferrule 66 that is positioned along rod 64 and serves to limit the pivot arc for the pivotably mounted cutting blades. Ferrule 66 can engage a notch on the back side of the cutting blades as can be seen in FIG. 8 when cutting blades 56 and 58 are in the extended position.

Figure 9:
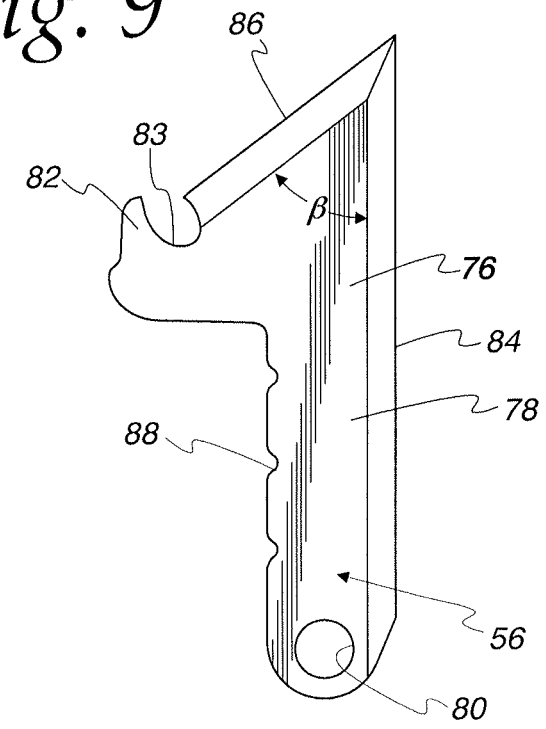
FIG. 9 is a side view of a cutting blade in the mechanical broadhead shown in FIG. 6.

Features of the cutting blades for the embodiment shown in FIGS. 6, 7 and 8 are illustrated in FIG. 9 which shows cutting blade 56 having a deltoid head portion 76 unitary with stem 78.

Minor cutting edge 86 and major cutting edge 84 on cutting blade 56 intersect and together define an acute angle beta ((3) which can be the same as, or different from the acute angle $\alpha$ for cutting blade 16 discussed hereinabove. Major cutting edge 84 extends along substantially the entire longitudinal dimension of cutting blade 56. Grab hook 82 is situated at the distal end of minor cutting edge 86 and is spaced therefrom by about two thickness dimensions of the cutting blade by recess 83 in cutting blade 56. The margin of cutting blade 56 opposite to major cutting edge 84 is provided with three notches such as notch sized to receive o-ring 62 (FIGS. 6 and 7) or the like elastomeric retainer. Pivot pin aperture 80 is provided at the distal end portion of stem portion 78.

Figure 10:
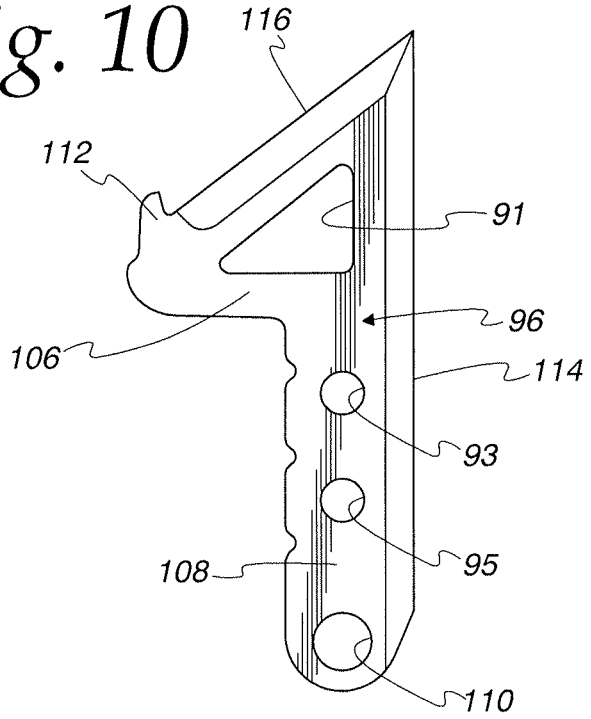
FIG. 10 is a side view of an alternate cutting blade suitable for the mechanical broadhead of FIG. 6.

An alternate cutting blade for broadhead 50 is depicted in FIG. 10. Cutting blade 96 has a pointed, sharp-edged configuration similar to that of cutting blade 56 (FIG. 9), has a head portion 106 and a unitary stem portion 108, but in addition is provided with cut-out 91 in head portion 106 and with cut-outs 93 and 95 in stem portion 108 to minimize the weight of cutting blade 96. Pivot pin aperture 110 is sized to receive a pivot pin for pivotable mounting to the body of a mechanical broadhead. Major cutting edge 114 along one side of the cutting blade 96 intersects with minor cutting edge 116 in head portion 106 and together with minor cutting edge 116 forms an acute angle. Grab hook 112 is provided at the distal end of minor cutting edge 116 adjacent thereto and performs the same function as grab hooks 42 and 82 on cutting blades 16 and 56, respectively.

The foregoing description and the drawings are illustrative of the present invention. Still other variants and rearrangements of parts are possible and will readily present themselves to those skilled in the art.

The invention claimed is:

1. A mechanical broadhead for an arrow shaft comprising an elongated body having a leading end and a trailing end, terminating in a threaded rod at the trailing end and defining a plurality of longitudinally extending slots substantially parallel to longitudinal axis of the elongated body but offset therefrom;

a faceted penetrating tip mounted to the elongated body at the leading end;

a cutting blade pivotably mounted to the elongated body in each said longitudinally extending slot and pivotable from a folded position to an extended position;

an elastomeric retainer engaging each cutting blade and urging the cutting blade into the longitudinally extending slot; and having a ferrule threadedly received on the threaded rod and defining a pivot arc limit for the cutting blade;

each cutting blade having a minor cutting edge, a major cutting edge, and a grab hook at the distal end of the minor cutting edge; the major cutting edge being received within the longitudinally extending slot when the cutting blade is in the folded position and the minor cutting edge together with the major cutting edge defining an acute angle therebetween.

2. The mechanical broadhead in accordance with claim 1 wherein the acute angle is about 45 degrees.

3. The mechanical broadhead in accordance with claim 1 wherein each cutting blade is provided with at least one notch adapted to receive the elastomeric retainer.

4. The mechanical broadhead in accordance with claim 3 wherein each cutting blade is provided with a plurality of spaced notches adapted to receive the elastomeric retainer.

5. The mechanical broadhead in accordance with claim 1 wherein the elastomeric retainer is an o-ring.

6. The mechanical broadhead in accordance with claim 1 wherein three cutting blades uniformly spaced from one another are pivotably mounted to the elongated body.

7. A mechanical broadhead for an arrow shaft comprising an elongated body having a leading end and a trailing end, terminating in a threaded rod at the trailing end and defining a plurality of longitudinally extending slots substantially parallel to longitudinal axis of the elongated body but offset therefrom;

a faceted penetrating tip mounted to the elongated body at the leading end;

a cutting blade pivotably mounted to the elongated body in each said longitudinally extending slot and pivotable from a folded position to an extended position; and an elastomeric retainer engaging each cutting blade and urging the cutting blade into the longitudinally extending slot;

each cutting blade having a minor cutting edge, a major cutting edge, and a grab hook at the distal end of the minor cutting edge; the major cutting edge being received within the longitudinally extending slot when the cutting blade is in the folded position and the minor cutting edge together with the major cutting edge defining an acute angle therebetween and wherein each said cutting blade has a pointed, sharp-edged configuration and comprises a deltoid head portion and a stem portion unitary with the head portion.

8. The mechanical broadhead in accordance with claim 7 wherein cutting blade length ratio of major cutting edge-to-minor cutting edge is in the range of about 2 to about 4.

9. The mechanical broadhead in accordance with claim 7 wherein the grab hook projects beyond the minor cutting edge.

10. A mechanical broadhead for an arrow shaft comprising an elongated body having a leading end and a trailing end, terminating in a threaded rod at the trailing end and defining a plurality of longitudinally extending slots substantially parallel to longitudinal axis of the elongated body but offset therefrom;

a faceted penetrating tip mounted to the elongated body at the leading end;

a cutting blade pivotably mounted to the elongated body in each said longitudinally extending slot and pivotable from a folded position to an extended position; and an elastomeric retainer engaging each cutting blade and urging the cutting blade into the longitudinally extending slot;

each cutting blade having a minor cutting edge, a major cutting edge, and a grab hook at the distal end of the minor cutting edge; the major cutting edge being received within the longitudinally extending slot when the cutting blade is in the folded position and the minor cutting edge together with the major cutting edge defining an acute angle therebetween and wherein each said cutting blade defines a recess between the grab hook and the minor cutting edge.

11. The mechanical broadhead in accordance with claim 10 wherein the cutting blade is pivotable in an arc of about 110 degrees to about 160 degrees.

12. The mechanical broadhead in accordance with claim 10 wherein the cutting blade is pivotable in an arc of about 135 degrees.

13. The mechanical broadhead in accordance with claim 10 wherein cutting blade length ratio of major cutting edge-to-minor cutting edge is in the range of about 2 to about 4.

14. The mechanical broadhead in accordance with claim 10 wherein each said cutting blade has a pointed, sharp edged configuration and comprises a deltoid head portion and a stem portion unitary with the head portion.

15. The mechanical broadhead in accordance with claim 10 wherein three cutting blades uniformly spaced from one another are pivotably mounted to the elongated body.

16. The mechanical broadhead in accordance with claim 10 wherein the acute angle is about 45 degrees.

17. The mechanical broadhead in accordance with claim 10 wherein the cutting blade is provided with at least one notch adapted to receive the elastomeric retainer.

18. The mechanical broadhead in accordance with claim 17 wherein the cutting blade is provided with a plurality of spaced notches adapted to receive the elastomeric retainer.

19. The mechanical broadhead in accordance with claim 10 wherein the elastomeric retainer is an o-ring.

* * * * *